United States Patent [19]

Jensen

[11] 4,140,067

[45] Feb. 20, 1979

[54] FURNACE CONTROL SYSTEM

[75] Inventor: Thomas A. Jensen, Cannon Falls, Minn.

[73] Assignee: T. Jensen Associates Inc., Cannon Falls, Minn.

[21] Appl. No.: 845,918

[22] Filed: Oct. 27, 1977

[51] Int. Cl.[2] ..... F23C 1/06; F23D 17/00

[52] U.S. Cl. ..... 110/262; 110/186; 110/187; 236/1 E; 431/6

[58] Field of Search ..... 110/260–262, 110/191, 186, 187, 234; 431/6, 12; 236/1 A, 1 E, 1 H, 15 R; 122/2

[56] References Cited

U.S. PATENT DOCUMENTS

| | | | |
|---|---|---|---|
| 1,858,450 | 5/1932 | Coutant | 110/261 |
| 2,176,009 | 10/1939 | Lange | 110/262 |
| 2,848,958 | 8/1958 | Kolman | 110/262 |
| 3,223,074 | 12/1965 | Tanner et al. | 122/2 |
| 3,702,594 | 11/1972 | Howes | 110/187 |
| 4,024,378 | 5/1977 | McIntosh | 236/1 E |
| 4,047,515 | 9/1977 | Daniel | 126/110 R |
| 4,078,541 | 3/1978 | Roycraft | 110/260 |

*Primary Examiner*—Henry C. Yuen

*Attorney, Agent, or Firm*—Warren A. Sturm; Hugh D. Jaeger

[57] ABSTRACT

A furnace control system to control burner operation of a multifuel furnace to reduce primary fuel consumption of either oil or gas of the multifuel furnace. The system controls a primary fuel to initially kindle a secondary fuel when the fire reaches a self-sustaining burning rate, the primary fuel is shut off but the burner fan continues to run to force a draft and insure complete combustion of the secondary fuel and the volatile gases. The furnace control system is utilized as original equipment manufacturer incorporated into the controls for a burner of a multifuel furnace or as a retrofit furnace control system to control the burner operation of the multifuel furnace.

11 Claims, 1 Drawing Figure

FURNACE CONTROL SYSTEM

BACKGROUND OF THE INVENTION

1. Field of the Invention

The present invention relates generally to improvements in furnaces and more particularly pertains to a new and improved furnace control system to control burner operation of a multifuel furnace to reduce the fuel consumption of the primary fuel of either gas or oil.

2. Description of the Prior Art

In the field of multifuel furances, it has been a general practice to employ control systems to combust the fuels of oil or gas, the primary fuel, and wood or coal, the secondary fuel, the most common being multifuels using the combination of either oil or gas and wood. Such systems have been unsatisfactory in that there has been a failure to reach complete combustion of the fuel by not providing enough air to consume the volatile gases given off by the secondary fuel which contain approximately fifty percent of the heat value of the fuel. These prior art multifuel furnaces can be characterized as charcoal kilns which then consumes the charcoal it has produced.

Some prior art multifuel furnaces on the market today operate extremely inefficiently in producing probably around half the heat the multifuel furnaces are capable of producing thereby operating at an efficiency of fifty percent. The other half of the heat, lost through inefficiency of the furnace, is contained in the unburned volatile gases which are lost up the chimney flue into the outside environment. The prior art multifuel furnaces are unable to provide the proper quantity of air to completely combust the volatile gases. Also, other prior art systems introduce secondary combustion air into the secondary combustion chamber for the burning of the secondary fuel with the result that there is either too much air when primary fuel alone is being burned or too little air when both primary and secondary fuels are simultaneously being burned. This results in either chilling of the heat exchanger with too much air or incomplete combustion with too little air. As a consequence, the prior art multifuel furnaces operate inefficiently.

This invention provides a furnace control system for use with a multifuel furnace to reduce the primary fuel consumption and provide for complete combustion of the primary and secondary fuels.

SUMMARY OF THE INVENTION

The present invention obviates the foregoing disadvantages of the prior art by providing a fuel control system for multifuel furnaces which reduces the primary fuel consumption and further provides for complete combustion of the secondary fuel in the multifuel furnace.

According to an embodiment of the present invention, there is provided a fuel burning chamber in a multifuel furnace, a fuel burner for igniting a primary fuel and a secondary fuel, a fan for introducing air into the fuel burning chamber, a heat exchanger in the fuel burning chamber, a circulating fan to couple heat from the heat exchanger to surrounding environment, a combination fan limit control switch to control the supply of air to the fuel burning chamber and to advance a stepping relay on eliminating one fuel source, a high limit switch to prevent damage to the heat exchanger, circuitry to repeat the advancement of the stepping relay until the secondary fuel sustains combustion each time the primary fuel source is eliminated, a valve or clutch, motor, device, etc. to cut off the primary fuel source and a pressure switch to varify that the primary fuel has been cut off before continuing the sequence. The furnace control system also includes circuitry to repeat the fuel cut-out operation five times before the system locks out requiring operation of the burner with primary fuel until the secondary fuel is replenished and the control is manually reset to the starting point of the sequence. Pilot lights are further provided to indicate at what stage the system is prior to the lock out step.

A significant aspect and feature of the present invention is a furnace control system which disables the supply of primary fuel, whether it be either oil or gas to the burner but yet continues to supply air for combustion of the secondary fuel, either wood or coal. Air is supplied as heat is demanded by the thermostat to facilitate complete combustion of the secondary fuel through the inherent design of the furnace electrical circuitry controls.

An advantageous feature of the present invention resides in that supplying air to the secondary fuel in the absence of the primary fuel in the burning chamber of the furnace, complete combustion of not only the fuel but of the volatile gases occurs yeilding a higher heating efficiency for burning the same quantity of fuel.

Having briefly described an embodiment of the present invention, it is a principal object thereof to provide a new and improved furnace contol system for a multifuel furnace.

It is an object of the present invention to provide a furnace control system to provide for complete combustion of not only the primary but also the secondary fuels, and by combusting the volatile gases expended from the secondary fuel.

It is another object of the present invention to provide a furnace control system for the multifuel furnace which automatically switches off the primary fuel and continues the supply of air to burn the secondary fuel.

It is a further object of the present invention that in the event the secondary fuel does not continue to burn, the furnace control system will initiate burning the primary fuel to again ignite the burning of the secondary fuel and continue to repeat this operation until a predetermined number of ignition attempts is reached, at which time the primary fuel cut off system locks itself out and the furnace continues to run on the primary fuel alone until resupplied with secondary fuel and the system is manually reset.

A still further object of the present invention is to provide a furnace control system for disabling the burner to permit the insertion of the secondary fuel into the furnace. This switch prevents ignition of the primary fuel or the secondary fuel during the stoking of the furnace, whether it be with wool or coal, etc.

An additional object of the present invention is to provide a multifuel furnace system which operates with the secondary fuel system disabled on the primary fuel supply.

A still additional object of the present invention is to provide that the furnace accessories such as a circulating fan, an electrostatic filter, a humidifier, etc., can operate when both the primary and secondary fuel control systems are disabled.

A further additional object of the present invention is to provide that the entire furnace control system including accessories, and primary and secondary fuel systems can be disabled at the control.

BRIEF DESCRIPTION OF THE DRAWING

Other objects and many of the attendant advantages of this invention will be readily appreciated as the same becomes better understood by reference to the following detailed description when considered in connection with the accompanying drawing, in which like reference numerals designate like parts throughout the FIGURE thereof and wherein:

FIG. 1 illustrates an electrical circuit schematic of the present invention.

DESCRIPTION OF THE PREFERRED EMBODIMENT

Figure 2:
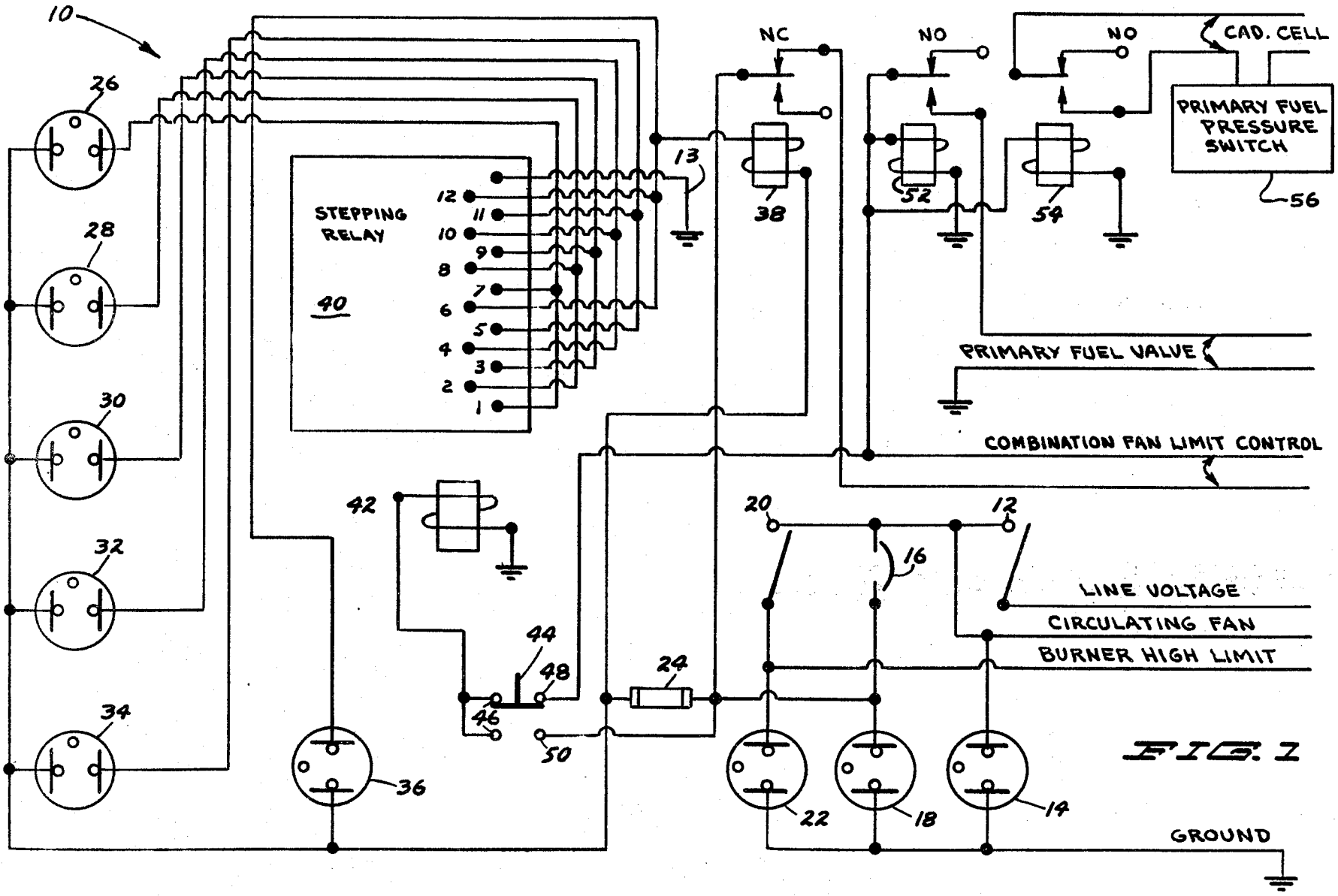

FIG. 1 illustrates a preferred embodiment of the present invention, a furnace control system 10 for a multifuel furnace having a primary fuel of either oil or gas and a secondary fuel of either wood or coal. Line voltage, such as 120 volts A.C. at 15 amperes for way of example and purposes of illustration only, connects to one side of a single pole single throw switch (SPST) 12. A other side of the SPST switch 12 connects to a circulating fan for a heat exchanger of a multifuel furnace, not illustrated in the FIGURE. A pilot lamp 14 connects between the other side of the SPST switch 12 and ground to indicate when the SPST switch 12 is closed. A circuit breaker 16 in series with a pilot lamp 18 connects between the other side of the SPST switch 12 and ground. One side of a SPST switch 20 connects to a burner high limit switch of the multifuel furnace not illustrated in the FIGURE and a other side of the SPST switch 20 connects to the junction of the circuit breaker 16 and the other side of the SPST switch 12. A pilot light 22 connects between the one side of the SPST switch 20 and ground. One side of a fuse 24 connects to the junction of the circuit breaker 16 and the pilot light 18, and a other side of fuse 24 connects to one side of a relay coil of a normally closed relay 38 and to one side of pilot lamps 26–36. The other side of relay coil 38 connects to contacts 6 and 12 of a 12 position stepping relay 40. Contacts 1 and 7 of the stepping relay 40 connect to the other side of the pilot lamp 26; contacts 2 and 8 of the stepping relay 40 connect to the other side of the pilot light 28; contacts 3 and 9 of the stepping relay 40 connect to the other side of the pilot lamp 30; contacts 4 and 10 of the stepping relay 40 connect to the other side of the pilot lamp 32; contacts 5 and 11 of the stepping relay 40 connect to the other side of the pilot lamp 34; and contacts 6 and 12 of the stepping relay 40 connect to the other side of the pilot lamp 36. The stepping relay 40 is actuated by a relay coil 42 which connects between ground and both poles on one side 46 of the double pole momentary contact switch 44. The pole 48 on the other side of the double pole momentary contact switch 44 connect to one side of a combination fan limit control, such as a "Honeywell", on the multifuel furnace. The other pole 50 on the other side of the double pole momentary contact switch 44 connects to the other side of the combination fan limit control of the multifuel furnace through the normally closed contacts of the relay 38 and to the junction between fuse 24 and the junction between breaker 16 and pilot lamp 18. The one side of the combination fan limit control connects to contact 48 of the switch 44 and also connects to the relay coils for normally open relays 52 and 54, the other side of the coils being connected to ground. The one side of combination fan limit control further connects to the normally open contact of the relay 52 while the other contact of the relay 52 connects to the primary fuel valve of the multifuel furnace. The normally open contact of the relay 54 connects to one side of a cadmium cell not illustrated in the FIGURE of the multifuel furnace and the other contact of the relay 54 connects to the other side of the cadmium cell through a primary fuel pressure switch 56 of the multifuel furnace to shunt out the flame sensing cadmium cell.

Preferred Mode of Operation

The furnace control system 10 may be mounted in any convenient position near the multifuel furnace on a surface that remains at or near room temperature but not necessarily onto the furnace structure. Power is provided to the furnace control system 10 through the ground and the line voltage which connects to one side of the SPST switch 12. The other side of the SPST switch 12 and the pilot light 14 connects to the circulating fan of the heat exchanger, and any other associated furnace electrical equipment such as the heat reclaimer and electrostatic filter, humidifier, etc. The junction of the one side of the SPST switch 20 and the pilot light 22 connects to the burner high limit switch which then supplies power to the burner pump, burner fan motor, etc. The one side of the combination fan limit control connects to the pole 48 of the double pole momentary contact switch 44, the relay coils 52 and 54, and the normally open contact of the relay 52. The other side of the combination fan limit control connects to the normally closed contact of relay 38. The normally open contact of relay 54 and the one side of the primary fuel pressure switch 56 connects to the cadmium cell of the multifuel furnace. The normally open contact of relay 52 connects to the primary fuel valve installed in the primary fuel line. Once the furnace control system 10 is installed in the multifuel furnace, it is ready for operation.

Operation of the furnace control system 10 occurs in the following manner. The switch 12 which connects to the line voltage is the main power switch. The switch 20 is opened as a safety factor to disable the burner so that the secondary fuel such as wood or coal can be thrown into the fire chamber without being ignited by the primary fuel and subsequently the door is closed. The burner switch 20 is closed to turn on the multifuel furnace and activate the furnace control system 10.

The double pole momentary contact switch 44 is pushed to reset the stepping relay 40 through relay coil 42 to the first of five primary fuel off positions as indicated by the pilot light 26. Once the combination fan limit control of the multifuel furnace closes, because the bonnet temperature of the furnace has reached a temperature at which the secondary fuel should be burning at a self-sustaining rate, the control switches off the primary fuel and causes the burner fan to force draft the secondary fuel souce which continues to burn and supply heat. In the event that the secondary fuel fire begins to burn at a reduced rate because insufficient mass of the secondary fuel has been ignited or the fuel has been consumed, the combination fan limit control opens and in doing so, advances the stepping relay 40 through the relay coil 42 to position 2 to light the pilot 28 and opens, the primary fuel valve and the cadmium cell shunt, causing the primary fuel to again burn. Every time that the combination fan limit control opens the stepping relay 40 through relay coil 42 advances one position as indicated by pilot lights 26–34 which for example may be green pilot lights, and locks out on the sixth switching, the predetermined number for way of example and illustration only, as indicated by pilot light 36 which may be a red pilot light. On lock-out occuring, having reached the predetermined number, it is necessary to replenish the secondary fuel in order for the furnace to operate without the primary fuel. In the event the secondary fuel is not replenished the furnace will operate indefinitely on primary fuel. Fuse 24 provides contact protection for the stepping relay contacts on the stepping relay 40. In the event to not only reset but to advance the stepping relay 40, switch 44 may be pressed to bypass the combination fan limit control to automatically advance the stepping relay to the initial starting position where the pilot light 26 illuminates. For ease of construction and accessibility, a 12 position stepping relay 40 was utilized in explanation of the present invention but any stepping relay having multiples of six positions may be incorporated into the system or any number of positions corresponding to the predetermined number for lock-out.

Various modifications can be made to the furnace control system of the present invention without departing from the apparent scope of the invention.

While the predetermined number of burner switching operation is six to lock-out and disabling of the furnace control system, the number can be chosen to be more or less, and is not to be construed as limiting of the furnace control system 10. Any suitable stepping relay having any number of positions can be utilized as relay 40. Also, solid state switching circuitry can be substituted for the electro-mechanical relays 40, 38, 52 and 54 as well as LED sequence display in lieu of the pilot lights. A remote sequence display in lieu of the pilot lights. A remote sequence display 26–36 and a remote switch 20 may be positioned remote from the furnace control system 10. In the event an operator wishes to override the furnace control system 10, breaker 16 disables the entire system so that the primary fuel can be exclusively burned. The furnace can also be the type having multiple fuel burning chambers.

Having thus described the invention, there is claimed as new and desired to be secured by Letters Patent:

1. A fuel control system to control burning of a primary and a secondary fuel in a multifuel furnace comprising:

a. fuel burning chamber means in a multifuel furnace for burning a primary fuel and a secondary fuel;

b. primary fuel burner for igniting fuels;

c. burner fan means for introducing air into said fuel burning chamber;

d. heat exchanger means in said fuel burning chamber;

e. circulating fan means to transfer heat from said heat exchanger means to a surrounding environment;

f. a combination fan limit control means connected to said burner fan means for controlling the supply of air to said fuel burning chamber means;

g. a first relay means connected to said combination fan limit control means whereby said relay is actuated every time said combination fan limit control means is energized; and;

h. lock-out means connected to said first relay means whereby said first relay means is disabled by said lock-out means after a predetermined number of energizations of said combination fan limit control means.

2. The fuel control system of claim 1 wherein said first relay means is a stepping relay.

3. The fuel control system of claim 1 wherein said first relay means is a six position stepping relay.

4. The fuel control system of claim 1 wherein said first relay means is a twelve position stepping relay.

5. The fuel control system of claim 1 wherein said predetermined number is six to lock-out said first relay means.

6. The fuel control system of claim 1 wherein said lock-out means comprises a second relay means connected to first relay means whereby said second relay means disables said first relay means after said predetermined number is reached.

7. The fuel control system of claim 6 wherein said second relay means has normally closed contacts.

8. The fuel control system of claim 8 further comprising a third relay means connected to said second relay means whereby said third relay means closes a primary fuel valve after a predetermined temperature is reached.

9. The fuel control system of claim 8 wherein said third relay means has normally open contacts.

10. The fuel control system of claim 9 further comprising a fourth relay means connected to said second relay means whereby said fourth relay means in series with a primary fuel pressure switch disables a cadmium cell in said primary fuel burner.

11. The fuel control system of claim 10, wherein said fourth relay means has normally open contacts.

* * * * *